United States Patent [19]

Kelly

[11] 3,933,104

[45] Jan. 20, 1976

[54] CUTTING MECHANISM FOR SEWING MACHINE

[75] Inventor: Edward A. Kelly, Wethersfield, Conn.

[73] Assignee: The Merrow Machine Company, Hartford, Conn.

[22] Filed: Dec. 30, 1974

[21] Appl. No.: 537,628

Related U.S. Application Data

[62] Division of Ser. No. 354,714, April 26, 1973.

[52] U.S. Cl. ..... 112/121.2; 26/10.4

[51] Int. Cl.[2] ..... D05B 37/04

[58] Field of Search ..... 112/122, 128, 129, 125, 112/126

[56] References Cited

UNITED STATES PATENTS

| | | | |
|---|---|---|---|
| 698,912 | 4/1902 | Durand | 112/129 |
| 1,312,413 | 8/1919 | Moffatt | 112/122 |
| 1,977,505 | 10/1934 | Chudner | 112/122 |
| 1,994,385 | 3/1935 | Chudner | 112/122 |
| 2,085,643 | 6/1937 | Ebert | 112/122 |

*Primary Examiner*—George H. Krizmanich
*Attorney, Agent, or Firm*—Browne, Beveridge, DeGrandi & Kline

[57] ABSTRACT

A trimming mechanism for an overedge sewing machine includes an elongated cutter arm driven in oscillatory movement to drive a movable cutting blade which cooperates with a fixed cutting blade to trim material passed through the sewing machine. An improved cutting blade mounting means is provided for simultaneously mounting the movable cutter blade on the driven cutter arm and automatically aligning the movable blade for cooperation with the fixed blade.

4 Claims, 20 Drawing Figures

FIG. 2
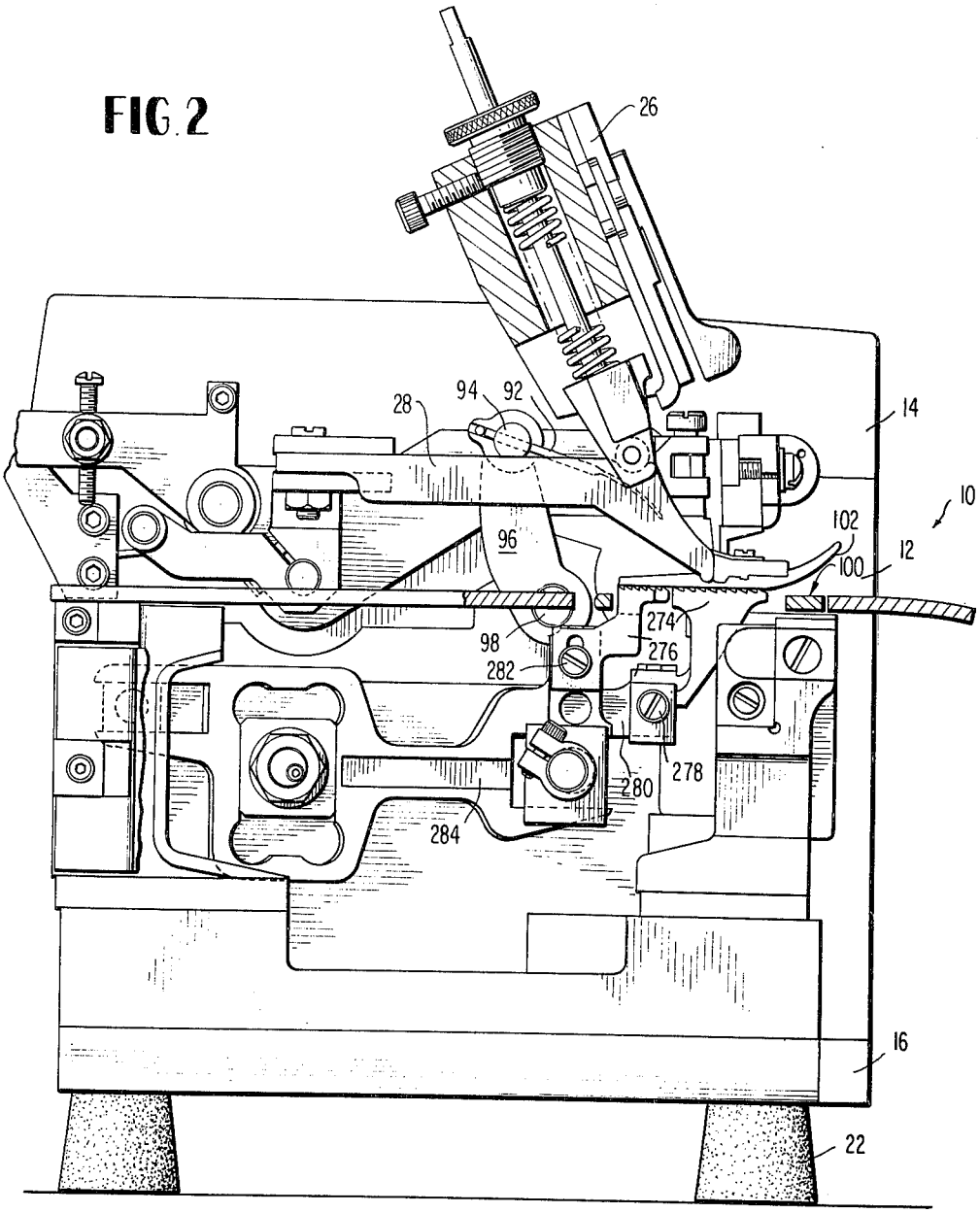
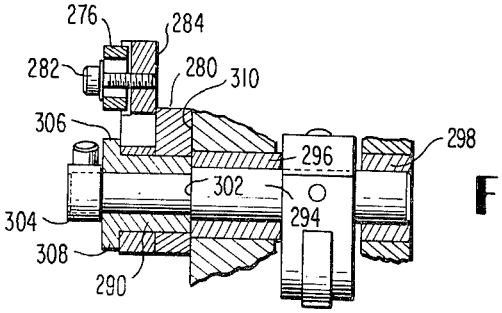
FIG. 8

FIG.9
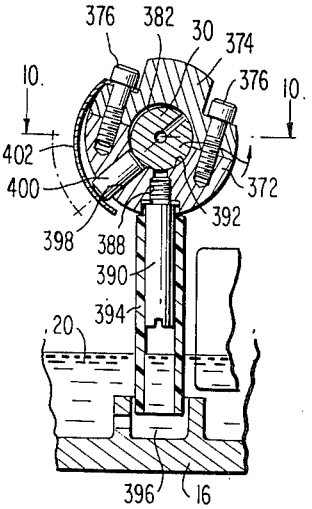
FIG.10
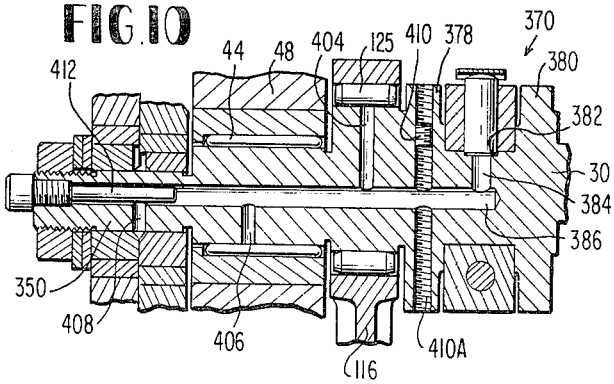
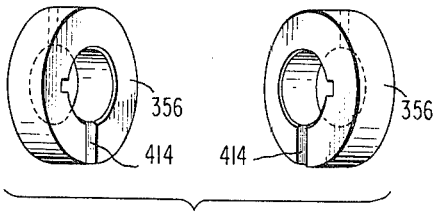
FIG.11
FIG.12
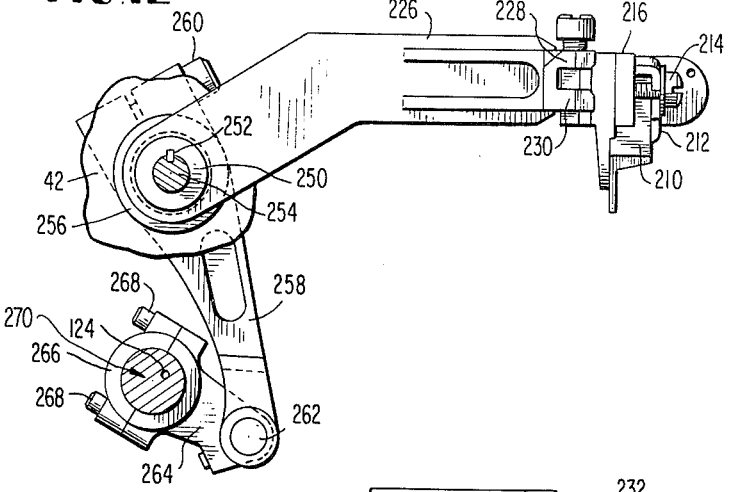
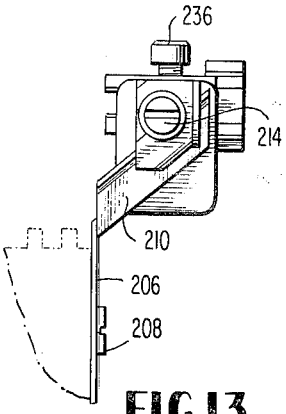
FIG.13
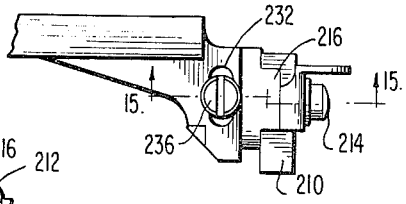
FIG.14
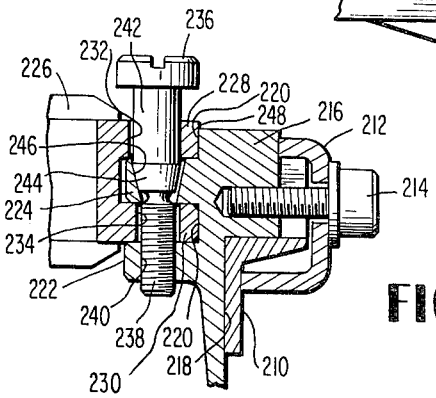
FIG.15

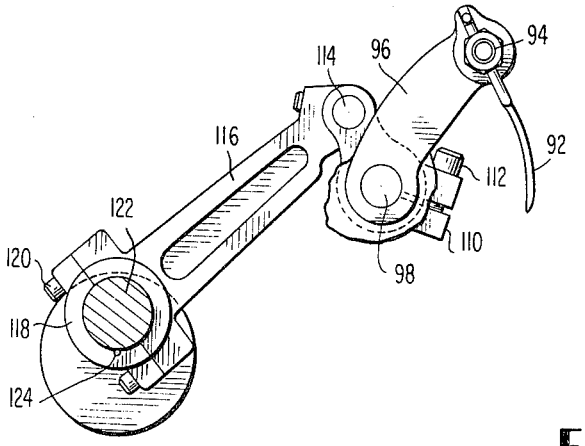
FIG. 16
FIG. 17
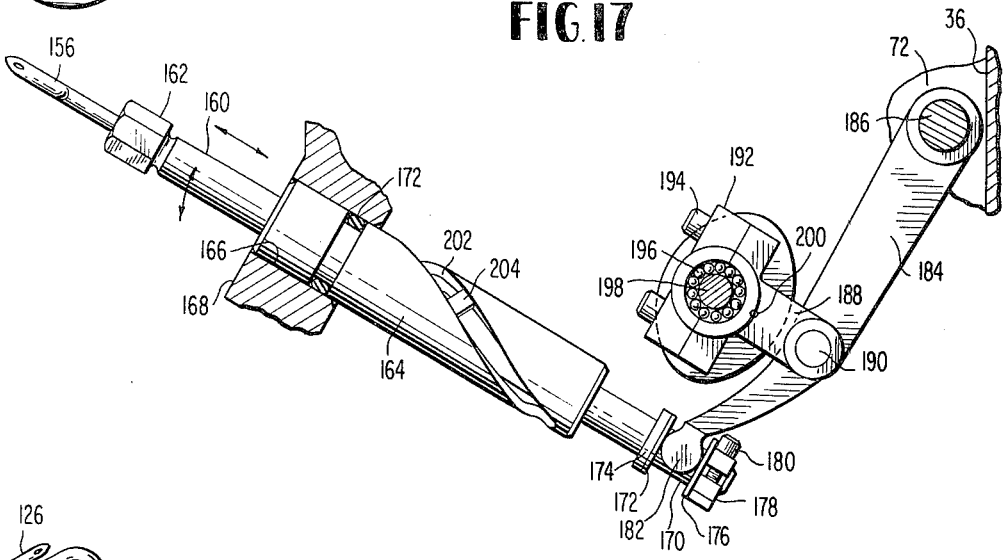
FIG. 18
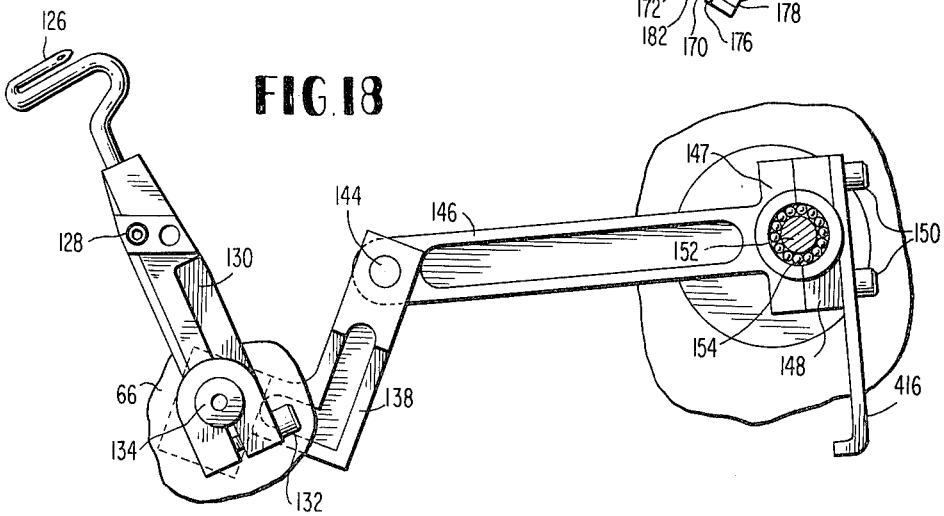

CUTTING MECHANISM FOR SEWING MACHINE

This is a division, of application Ser. No. 354,714, filed Apr. 26, 1974.

BACKGROUND OF THE INVENTION

1. Field of the Invention

This invention relates generally to sewing machines and more particularly to an improved high speed industrial sewing machine of the type employed to produce a seam along and around the edge of a workpiece as it is progressively fed through the machine.

2. Background of the Invention

Overedge sewing machines are widely used, particularly in industrial sewing operations, to form a one, two, or three thread seam along the free edge of the workpiece. In operation, these machines pass successive loops of a needle thread through the workpiece at spaced intervals along a line spaced inwardly from and parallel to the edge of the workpiece, with the successive loops being either interlooped with themselves or with one or two looper threads around the edge to complete the overedge seam.

As with any commercial operation, the speed of an industrial sewing machine is an important consideration. This factor has been largely responsible for the widespread acceptance of the overedge machine which traditionally has been a high speed machine. While refinement in existing machine designs has made possible the operation of overedge machines at rates in excess of seven thousand stitches per minute, practical limitations both as to stress and acceptable noise levels, made it clear that further substantial increases in speed were not practical with the prior art machine designs. It is, therefore, a primary object of the present invention to produce an improved high speed overedge sewing machine.

Another object of the invention is to provide such a machine capable of operating at very high speeds without the production of excessive noise or vibration.

Another object is to provide such a machine in which shaft driven connecting rods mounted in fixed planes are employed to drive the working elements of the machine.

Another object is to provide such a machine employing an improved material feed mechanism for feeding the work material through the machine.

Another object is to provide such a machine including an improved means for lubricating relative inaccessible components thereof.

Another object of the invention is to provided such a machine employing a main input shaft and a miter gear driven auxiliary shaft for driving the working components of the machine.

SUMMARY OF THE INVENTION

In the attainment of the foregoing and other objects, an important feature of the invention resides in the use of a main input shaft and a miter gear driven auxiliary shaft extending at right angles to the main shaft to enable the use of bearing mounted connecting rods, each supported in its own fixed plane, for driving the material cutter, the feed mechanism, and the cooperating stitch forming elements of the machine. The right angle shafts eliminates the need for spatial or ball-jointed linkages or axial cams to drive the stitch forming elements as in the prior art overedge machines.

The four-motion feed dogs of the machine are driven in their horizontal movement through an eccentric crank on the projecting end of the main shaft, and in their vertical movement by a connecting rod mounted on and driven by the main shaft. The feed drive arrangement includes means for stabilizing the feed dogs against canting movement under load of the machine's presser foot, and means for shifting the feed carriers during actuation thereof to move the feed dogs in a substantially elliptical path having its major axis in the horizontal direction. A shaft mounted, floating pump is provided to pump oil through the main input shaft to lubricate portions of the feed carrier drive assembly. Means are also provided for automatically aligning the plane of the material cutter of the machine with the main input shaft to thereby greatly facilitate installation and alignment of the cutter knife.

BRIEF DESCRIPTION OF THE DRAWINGS

The foregoing objects and advantages of the machine according to the present invention will become more apparent from the following detailed description, taken with the drawings, in which:

FIG. 2 is an end elevation of the machine shown in FIG. 1 and illustrating the feed carrier drive mechanism;

FIG. 8 is a sectional view taken on line 8—8 of FIG. 4;

FIG. 9 is a sectional view taken on line 9—9 of FIG. 2 and illustrating the shaft mounted oil pump;

FIG. 10 is a sectional view taken along line 10—10 of FIG. 9;

FIG. 11 is an exploded view of the feed carrier drive eccentric;

FIG. 12 is a fragmentary view illustrating the machine cutter drive mechanism;

FIG. 13 is a front elevation view of the cutter mechanism shown in FIG. 12;

FIG. 14 is a fragmentary top plan view of the structure shown in FIG. 12;

FIG. 15 is a sectional view taken along line 15—15 of FIG. 14;

FIG. 16 is a fragmentary end elevation view showing the needle drive mechanism;

FIG. 17 is a fragmentary sectional view illustrating the upper looper drive mechanism; and FIG. 18 is a fragmentary elevation view of the lower looper drive mechanism.

DESCRIPTION OF THE PREFERRED EMBODIMENTS

Figure 1:
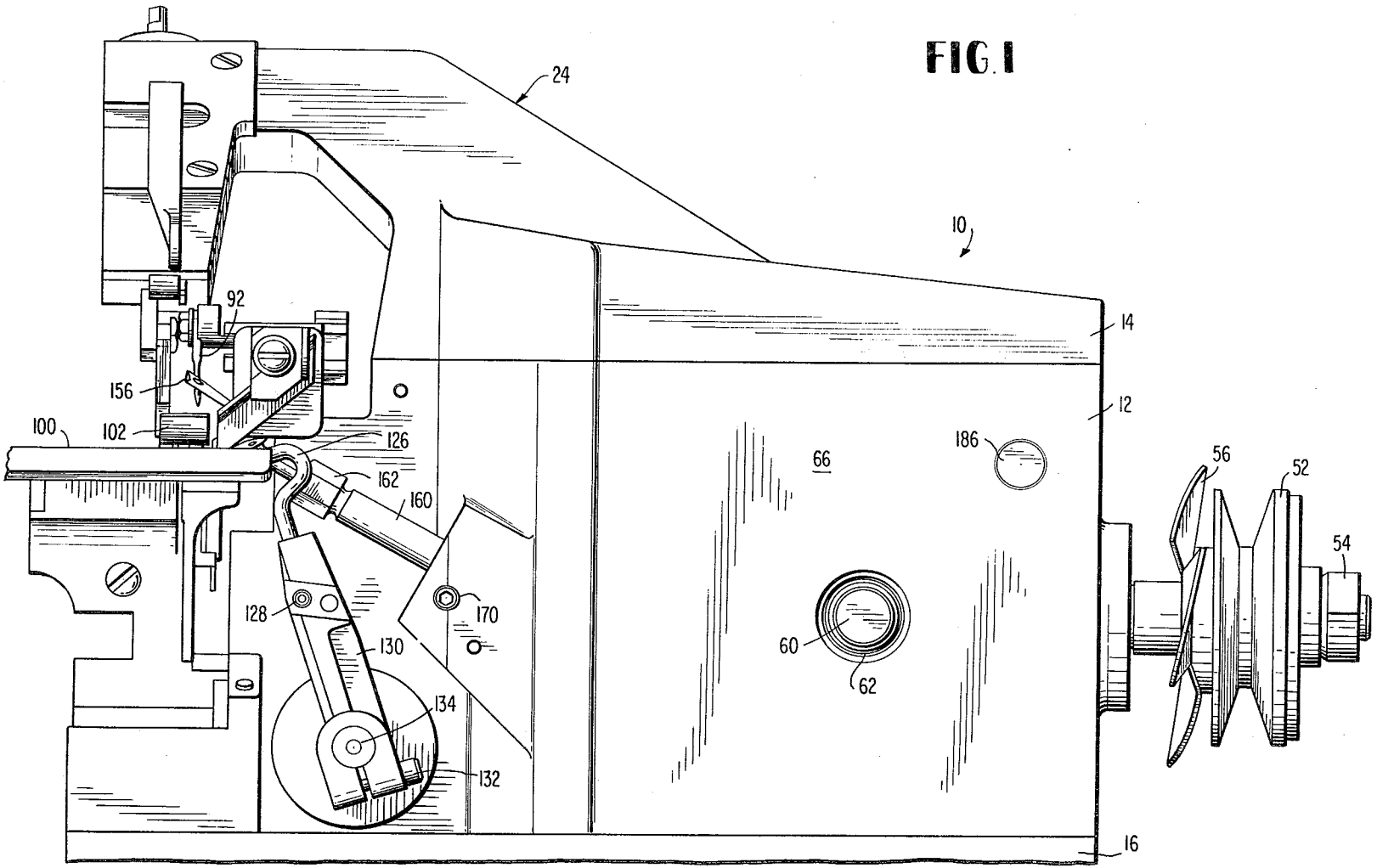
FIG. 1 is a front elevation view of the machine, with portions thereof removed to more clearly illustrate other portions.

Referring now to the drawings in detail, a sewing machine embodying the present invention is illustrated as including a housing 10 consisting of a main frame 12 and top and bottom cover plates 14, 16, respectively. The main drive components of the machine are supported by the main frame 12 within the open chamber 18 of the housing and an oil sump 20 (FIG. 9) in the bottom of the housing provides a supply of lubricating oil for the moving parts. The housing is supported on a suitable surface such as a conventional sewing table by resilient mounting feet 22 which provide maximum vibration dampening between the machine and its support. Preferably frame 12 is a single piece casting, although obviously the frame could be assembled from a plurality of components secured together in accurately aligned relation to form the fluit-tight compartment 18.

As seen in FIGS. 1 and 2, the top cover plate 14 includes a support arm 24 which carries thereon a presser foot loading and release assembly 26 for releasably urging the presser foot arm 28 in a direction to apply a downward force to a workpiece passing through the machine. Since the presser foot and its related components are of conventional construction and form no part of the present invention they will not be described in detail here. These structures have long been used on the well-known Merrow overedge sewing machine as illustrated, for example, in U.S. Pat. No. 2,827,869 and known to those skilled in the art. Also, conventional thread tensioning devices, not shown, are mounted on the cover plate 14 and support arm 24.

Figure 3:
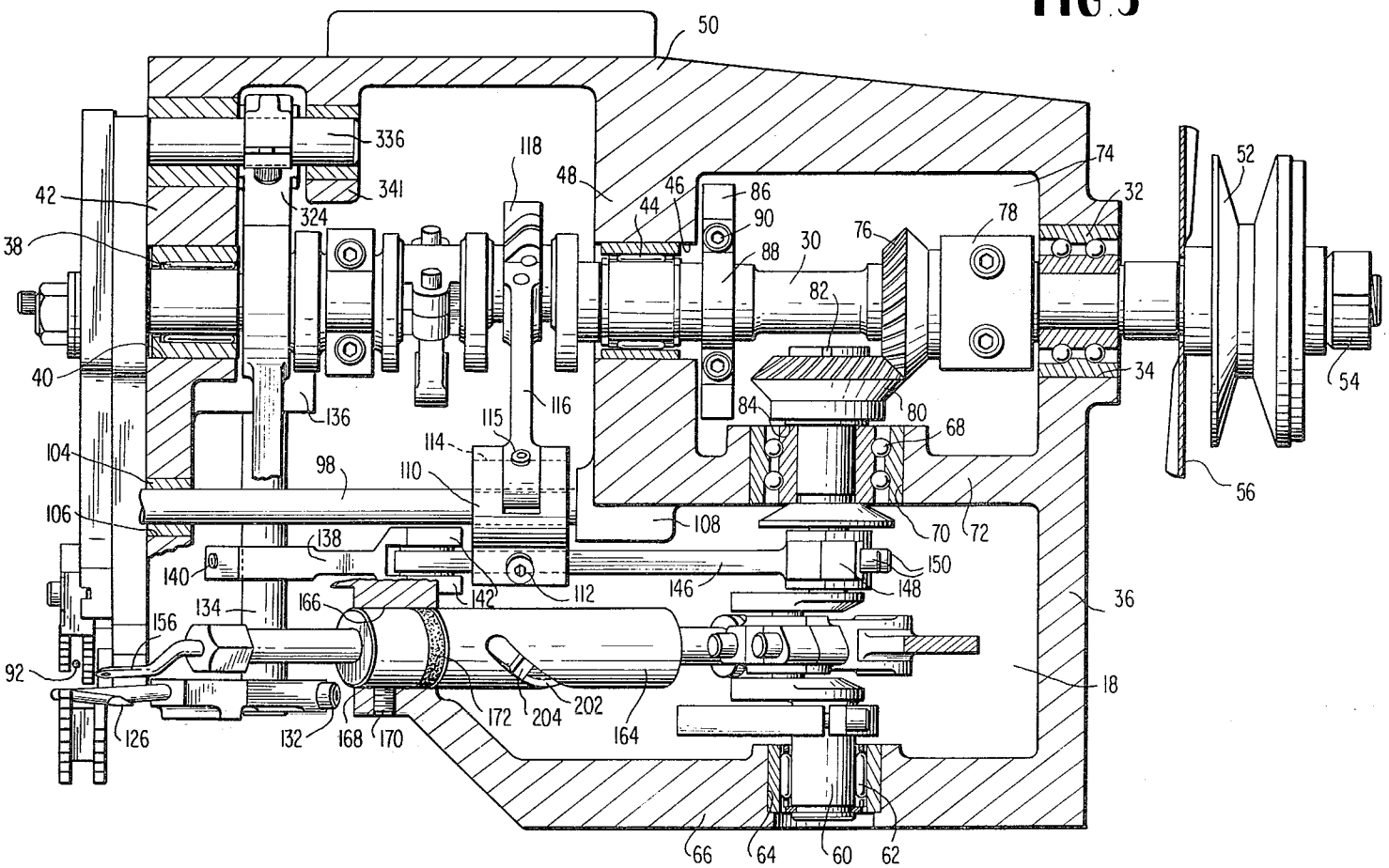
FIG. 3 is a plan view, partially in section, illustrating the drive mechanism of the machine.

Referring now to FIG. 3, it is seen that the machine drive system includes a main input shaft 30 journalled for rotation about its horizontal axis by main anti-friction bearing 32 supported in an opening 34 in the right end wall 36 of frame 12 and by an anti-friction needle bearing 38 mounted in an opening 40 in the left end wall 42 of the frame. Shaft 30 is also journalled intermediate its ends by a needle bearing 44 mounted within an opening 46 of a vertical, transversely extending wall 48 integrally formed with and projecting inwardly from the back wall 50 of frame 12.

The main input shaft 30 is driven about it longitudinal axis by a suitable motor acting through a V-belt, not shown, engaging a pulley 52 rigidly mounted on the outwardly projecting end of shaft 30 as by lock nut 54. A fan 56 may also be mounted on the shaft 30 between end wall 36 and the V-belt pulley 52, to provide a flow of cooling air over the portion of the frame adjacent the main bearing 32 during operation of the machine.

Although all anti-friction bearings in the external walls of frame 12 are illustrated in the drawings as being unsealed bearings, in practice suitable seals are provided to prevent the escape of lubricating oil to the outside of the housing. Since such seals are well-known and form no part of the invention, a detailed description and illustration of the seals has been omitted to simplify the disclosure.

An auxiliary drive shaft 60 is mounted within frame 12 by a needle bearing 62 positioned within an opening 64 in the front wall 66 of the frame and by a ball bearing 68 mounted within an opening 70 in a longitudinally extending inner wall 72 integrally formed with the inner wall 48 and the end wall 36. Shafts 30 and 60 are located within a common horizontal plane and extends at right angles to one another, with the inner end of shaft 60 being positioned closely adjacent shaft 30. Preferably, the inner walls 48, 72 do not extend the full height of frame 12 so that lubricating oil is free to pass both beneath and over the top of these walls to provide lubrication for the components located within the generally rectangular area 74 defined by these inner walls and the adjacent portion of end wall 36 and back wall 50.

Still referring to FIG. 3, it is seen that a first miter gear 76 is mounted on shaft 30 as by a key, not shown, in inwardly spaced relation to the main bearing 32, and a split ring clamp 78 mounted on the shaft between gear 76 and bearing 32 accurately spaces the gear with respect to the end wall 36. A second miter gear 80 is mounted on the end of shaft 60, as by key 82 and shims 84 which retain the gear in five spaced relation to the inner race of bearing 68. The miter gears 76, 80 mesh together so that rotation of shaft 30 by pulley 52 drives the shaft 60 at the same rate and in synchronization with shaft 30.

A counterweight 86 is also mounted on the shaft 30 within the rectangular space 74 by a split ring clamp 88 and a pair of bolts 90. This counterweight 86 acts to reduce vibration and noise by balancing forces exerted on the frame 12 by the driven components of the machine during operation thereof.

As shown in FIGS. 2, 3 and 16, a curved sewing needle 92 is mounted, as by clamp 94, on the distal end of a needle carrier arm 96 which, in turn, is rigidly mounted on the end of a rock shaft 98 for movement therewith to oscillate the needle through a workpiece passing over the needle plate 100 and beneath the presser foot 102 at the stitch forming station of the machine. The needle arm rock shaft 98 is journalled by a bushing 104 within an opening 106 in the end wall 42 of the frame, and by a second bushing, not shown, mounted in a bore in an enlarged portion 108 of the inner wall 48. A split rocker arm 110 is rigidly clamped, as by bolt 112, on the shaft 98 and is connected by pin 114 to one end of connecting rod 116. The connecting rod 116 has its other end rotatably mounted, as by clamp 118 and bolts 120, to an eccentric crank portion 122 of shaft 30. Thus, seen in FIG. 16, rotation of shaft 30 about its longitudinal axis, indicated at 124, will move the eccentric crank portion 122 in a circular orbital path thereby causing the rod 116 to impart oscillatory movement to the rocker arm 110 about shaft 98 to drive the needle 92 through an arcuate path from its raised position shown in FIG. 2 downwardly to a lowered position penetrating the material on the needle plate 100 and back to the raised position upon each rotation of the shaft 30. Although the rod 116 is illustrated in FIG. 16 as being journalled directly upon the eccentric crank 122, an anti-friction bearing 125 is actually employed as shown in FIG. 10.

As a loop of sewing thread is passed through a workpiece and carried below the needle plate 100 by the needle 92, the loop is picked off the needle by a lower looper 126 mounted, as by set screw 128, in the free end of a looper arm 130. The looper arm 130 has a split ring clamp integrally formed thereon and is rigidly mounted, as by bolt 132, on the end of a rock shaft 134 projecting outwardly from the front wall 66 of frame 12. The rock shaft 134 is journalled adjacent its outwardly projecting end by a suitable bushing or sealed bearing, not shown, in the front wall 66 and has its rear end journalled by a suitable bushing within an opening in an inwardly projecting protrusion 136 on the end wall 42.

Referring particularly to FIGS. 3 and 18, the lower looper rock shaft 134 is oscillated about its longitudinal axis by a crank arm 138 having one end rigidly mounted on the shaft 134 by a set screw 140 and has an integrally formed fork 142 at its other end. A pin 144 extending through the fork 142 pivotally supports one end of a connecting rod 146 which, in turn, has its other end mounted, as by split clamp 148 and bolts 150, to an eccentric crank portion 152 of auxiliary shaft 60. An anti-friction needle bearing 154 is provided between the eccentric crank portion 152 and the rod end 147 to minimize friction therebetween during operation of the machine. Since the eccentric crank 152, the bearing 154, the rod 146 and the crank arm 138 lie in a common plane, there will be no tendency for the rod 146 to rotate or oscillate about its longitudinal axis during operation to apply uneven loads to the bearings. Thus, it is seen that, upon rotation of the shaft 60, the eccentric crank portion 152 thereof will move in a circular orbital path to cause the rod 146, acting through pin 144, to oscillate the arm 138 about the axis of the rock shaft 134. Since arm 138 is rigidly clamped on the shaft 134, this oscillation will produce a similar oscillating movement of the lower looper 126 from a position in which the free end point of the looper is spaced to the left of a vertical plane parallel to the axis of shaft 134 and passing through the needle 92 (as viewed in FIG. 1) to a position to the right of this plane and back again upon each revolution of the input shaft 30. Further, since the auxiliary shaft 60 and input shaft 30 are driven in synchronization, movement of the lower looper 126 will be in timed relation with the needle 92 so that the looper will be in position to pick a loop of thread from the needle as the needle passes below the needle plate. Continued rotation of the shafts will move the lower looper to the right to the position shown in FIG. 1 and hold the loop of thread in position to be picked off by an upper looper 156 and carried into position above the needle plate 100 to be penetrated by the needle upon the next downward movement. Alternatively, as is well-known in the overedge sewing machine art, either the lower and upper looper may also carry a thread which is interlooped with the needle thread around the edge of the fabric being sewn to form a two or three thread overedge seam in the edge of the material.

Referring now particularly to FIGS. 3 and 17, it is seen that the upper looper 156 is mounted on the end of a looper rod 160 by a clamp nut 162. The looper rod 160 is slidably mounted in an axial bore of an elongated bearing sleeve 164 mounted in and projecting through an opening 166 in an inwardly offset, inclined portion 168 of the front wall 166. A set screw 170 firmly clamps the sleeve 164 in position, and a suitable packing gasket 172 provides a seal between the sleeve and the opening in the housing to prevent escape of lubricating oil.

The upper looper bearing sleeve 164 is supported in a vertical plane parallel to and spaced forwardly of the axis of input shaft 30 and is inclined at an angle of approximately 30° with respect to the horizontal so that reciprocation of the looper rod 160 through the bearing sleeve 164 moves the end of the upper looper 156 from a retracted position substantially level with the work support plate 100 to an extended position projecting substantially above the work support plate as seen in FIG. 1.

The upper looper rod 160 has a reduced diameter portion 170 adjacent its lower end and a first smooth hardened bearing washer 172 and a back-up washer 174 are mounted thereon in position abutting the snoulder (not shown) at the junction of the main body of the looper rod 160 and the reduced diameter portion 170. A second bearing washer 176 is mounted on the end of the reduced diameter portion in axially spaced relation to bearing washer 172, with the second bearing washer 176 being retained in position by a split ring clamp 178 and clamp bolt 180. The rounded, bifurcated end 182 of a rocking lever 184 is positioned between the bearing washers 172, 176 and cooperates therewith to provide a sliding swivel joint between the ends of the rocking lever and the looper rod. The upper end of the rocking lever 184 is pivotally mounted by a pin 186 fixedly mounted within openings in the front wall 66 and the interior wall 72, with the axis of pin 186 being parallel to and spaced from the axis of rotation of auxiliary shaft 60.

The rocking lever 184 is oscillated about the axis of pin 186 by a connecting rod 188 having a bifurcated end connected by rod pin 190 to the rocking lever 184 intermediate its ends. Connecting rod 188 has its other end connected, as by split clamp 192, bolts 194 and needle bearing 196, to an eccentric crank portion 198 of auxiliary shaft 60. Thus, upon rotation of the auxiliary shaft 60, the eccentric crank portion 198 will move in a circular orbital path around the shaft's axis of rotation, indicated at 200, and will impart oscillatory motion to the rocker arm 184 about the axis of pin 186. Oscillating movement of the rocking arm 184 will cause the curved bifurcated end portions 182 to swing through an arc while bearing on the face of the bearing washers 172, 176 and thereby impart reciprocating movement to the upper looper rod axially through the looper carrier bearing sleeve 164. The opposed parallel faces of the bearing washers 172, 176 will readily accommodate limited sliding motion between the end of the rocker arm and the washers as the rocker arm moves along its arcuate path.

The upper looper sleeve has an elongated spiral slot 202 formed therein, with the slot extending through the wall of the sleeve to the central bore thereof. The radially extending side walls of slot 202 form a spiral cam track which engages and guides a cam follower 204 which is mounted on looper rod 160 and projects radially outward therefrom through the slot 202. The configuration of the spiral slot 202 is such that, upon axial reciprocation of the looper rod 160, cam follower 204 will be constrained to follow the spiral path defined by the cam slot and thereby impart oscillatory rotary movement to the looper rod 160 and the looper 156 carried thereby. The sliding swivel joint between the rocker arm 154 and the looper rod 160 readily accommodates this limited oscillatory rotary movement.

As most clearly seen in FIG. 3, the looper 156 has an offset shank portion so that the thread-engaging point thereof is substantially offset from the longitudinal axis of the looper rod 160. This looper configuration, in combination with the rotary action imparted to the looper rod 160 and the angle of inclination of the looper sleeve 164, imparts substantial vertical movement to the point of the looper 156 upon each reciprocating movement thereof. This vertical movement enables the thread to be carried from the lower looper up and around the edge of a workpiece and positioned above the material where it is penetrated by the loop of thread carried by the needle on the next downward stroke thereof.

As is conventional with overedge machines, the machine of the present invention includes a cutter mechanism for automatically trimming the edge of a workpiece sewn thereon at a predetermined distance from the line along which the needle penetrates the workpiece to form the series of overedge stitches. Thus, a seam formed on such machines is always uniform and extends inward a fixed distance from the edge of the workpiece.

Referring to FIGS. 1–3 and 12–15, the cutter mechanism of the instant invention includes a fixed knife element 206 mounted, as by screw 208 on a structural member of the machine frame, and a movable knife 210 supported for substantially vertical reciprocating movement in contact with blade 206. The movable cutter blade 210 is in the form of a structural angle supported by a clamp 212 and screw 214 on a mounting bracket 216, with one leg of the structural angle projecting downwardly and remaining in contact with the vertical surface of the fixed cutter blade 206. The laterally extending leg of the angle defines the cutting or shearing edge of the movable cutter blade 210 and cooperates with the horizontal edge of the fixed cutter blade 206 to shear the edge of the workpiece along a straight line as the workpiece passes through the machine.

Movable cutter blade 210 is firmly clamped onto the mounting bracket 216 with a vertical surface of the cutter blade in contact with a flat vertical surface 218 which, in turn, is accurately formed in precise relation to an aligning surface 220 on the mounting bracket 216. A pair of flanges 222, 224 are integrally formed on the bracket 216 and project laterally from the aligning surface 220 in vertically spaced relation to one another for clamping the mounting bracket 216 onto the distal end of a cantilevered cutter arm 226. As best seen in FIG. 15, bracket 216 is supported on arm 226 by a pair of vertically spaced parallel flanges 228, 230 having parallel smooth faces adapted to engage the surface 220 of bracket 216 to accurately position the bracket on the arm. The pair of flanges 222, 224 on the bracket 216 are space apart a distance substantially equal to the thickness of the flange 230, and the pair of flanges 228, 230 on the arm 226 are spaced apart a distance substantially equal to the thickness of flange 224 so that the bracket 216 fits in snug tongue-and-groove relation on the end of the cutter arm.

Flanges 228 and 230 are provided wih vertically aligned elongated slots 232, 234, respectively, for receiving a clamping bolt 236. The bolt 236 has a threaded lower end portion 238 adapted to be threadedly received into an opening 240 in the flange 222 and an enlarged body portion 242 adjacent its upper end, with a tapered cone-shaped central portion 244 joining the threaded portion and the enlarged body. The tapered cone-shaped central portion 244 of the bolt 236 is adapted to engage a correspondingly tapered wall in an elongated opening 246 in the flange 224 as the bolt is threaded into the opening 240. This cams the bracket 216 toward the arm 226 and brings the vertical face 220 into firm contact with the end face 248 of the cutter arm 226 as defined by the ends of the flanges 228, 230.

As can be seen from FIG. 15, the vertical center line of the opening 232 is spaced from the face 248 a distance slightly greater than the vertical center line of the cone-shaped opening 246 from the aligning surface 220. Also, the transverse dimension of the elongated slots 232, 234 is slightly greater than the diameter of the adjacent portion of bolt 236 so that, as the bolt 236 is turned into the threaded opening 240, the body portion 242 of the bolt will bear against the side of slot 236 closest the end of cutter arm 226, and at the same time bear against the opposed surface of the cone-shaped opening 246 to cam the bracket 216 into firm contact with the end of the cutter arm. Further tightening of the screw 236 will result in the flange 230 being firmly clamped between the flanges 222 and 224 to thereby firmly and accurately position the bracket 216 and the cutter knife 210 carried thereby in relation to the support means for the cutter arm 226.

The cutter arm 226 is fixedly mounted on the end of an elongated mounting sleeve 250, as by key 252, for rotation therewith. The sleeve 250 is mounted on the presser foot mounting shaft 254, and is supported for rotation about its longitudinal axis by a mounting bushing 256 positioned within an opening in end wall 42, and a second bushing, not shown, mounted in an opening in the inner wall 48. Referring to FIG. 12, it is seen that the mounting sleeve 250 is oscillated about its longitudinal axis and comprises the fourth link of a four-bar linkage including a carrier lever 258 having a split end rigidly clamped on the sleeve by bolts 260 and having its other end connected, as by pin 262, to the end of a connecting rod 264. Rod 264 is, in turn, rotatably mounted on an eccentric crank portion 270 of main input shaft 30 by clamp 266 and bolts 268. Thus, rotation of shaft 30 about its longitudinal axis 124 will carry the end of the connecting rod 264 around a circular orbital path to thereby impart oscillating motion to the cutter lever 258 and raise and lower the knife 210 upon each revolution of the input shaft 30.

Work material is fed through the machine past the cutter mechanism and the stitch forming mechanism intermittent increments equal to the length of the successive stitches formed therein by aligned front and rear feed dogs 274, 276. The front feed dog 274 is mounted, as by screw 278, on the forward end of the front feed carrier 280, and the rear feed dog 276 is mounted as by screw 282 on the rear feed carrier 284. As seen from FIGS. 5 and 6, feed carriers 280, 284 are substantially identical except for their length, the front feed carrier 284 being slightly longer to position the front feed dog 274 ahead of and in line with the rear feed dog 276 in the direction of feed through the machine. Thus, feed carriers 280, 284 are provided with elongated, horizontally extending, open ended guide slots 286, 288, respectively, on their forward ends, with the guide slots being adapted to closely engage and slidably receive a feed raising block 290 which, in turn, is rotatably mounted on an eccentric crank portion 292 of a feed raising shaft 294. Feed raising shaft 294 extends in parallel spaced relation to input shaft 30 and is journalled for rotation about its longitudinal axis by a bushing 296 in the end wall 42, and a second bushing 298 in a rearwardly projecting protrusion 300 on front wall 66. The feed carrier block 290 is retained on the eccentric crank portion 292 with its inwardly directed end in contact with the end of bushing 296 and a radially extending shoulder 302 on shaft 294 by a split ring clamp 304 as best seen in FIG. 8.

The feed raising block 290 is provided with flanges 306, 308 on its upper and lower edges, respectively, which engage the outer vertical face of the feed carrier 284. The feed carriers 280, 284 are dimensioned so that their combined thickness is equal to or just slightly greater than the length of the feed raising block from the flanges 306, 308 to the opposite end thereof so that these flanges act to hold the two feed carriers in close contacting relation with one another and with the vertical surface of the front feed carrier 280 in contacting relation with a guide surface 310 on the end wall 42. As most clearly seen in FIGS. 3 and 4, the front feed dog 274 is offset from the vertical plane of the front feed dog carrier 280 so that pressure exerted by the work material and by presser foot 102 on this feed dog during operation of the machine exerts a counterclockwise moment (viewed from the front of the machine) on the feed dog carrier 280. The stabilizing effect of the flanges, 306, 308, bearing on the outer surface of the feed dog carrier 284, resists this turning moment and stabilizes the feed dogs against any canting or tilting movement about the longitudinal axis of the feed dog carriers.

The feed raising block 290 is driven in its orbital path by a lever 312 having one end rigidly clamped, by bolt 314, on feed raising shaft 294 and its other end connected, by pin 316, to one end of a connecting rod 318 having its other end rotatably mounted by bearing 320 on an eccentric crank portion 322 of input shaft 30. The connecting rod 318 also includes a rearwardly and downwardly projecting arm 324 having a stub shaft 326 mounted on the bifurcated distal end thereof. A generally rectangular guide block 328 is rotatably mounted on the shaft 326 and is slidably received within an elongated guide channel 330 of an arm 332. The arm 332 is rigidly clamped by bolt 334 onto a feed carrier pivot shaft 336 which, in turn, is supported for rotation about it longitudinal axis parallel to input shaft 30 by a bushing 338 mounted within an opening in the end wall 42 and a second bushing 340 supported in an inwardly directed bracket 341 on rear wall 50. Pivot shaft 336 terminates at its outer end in an eccentric crank portion 342 which rotatably supports a generally rectangular pivot block 344. The pivot block is received in the open ended, rearwardly extending guide channels 346, 348 of the feed carriers 280, 284, respectively to provide vertical support for the rear end of the feed carriers while permitting limited fore-and-aft and pivotal movement thereof.

Figure 4:
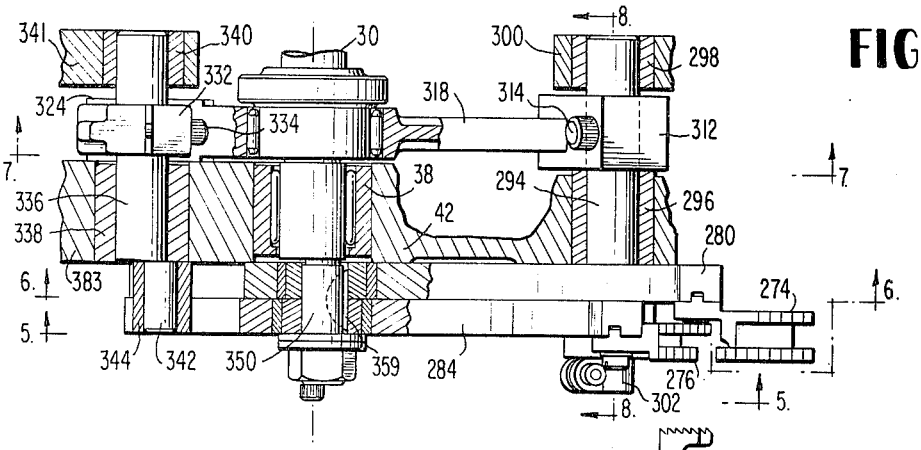
FIG. 4 is a fragmentary sectional view, in plan, illustrating the feed carrier drive mechanism.
Figure 5:
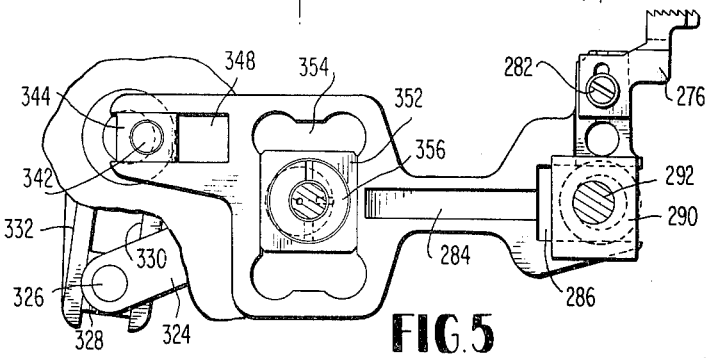
FIG. 5 is an elevation view taken on line 5—5 of FIG. 4.
Figure 5A:
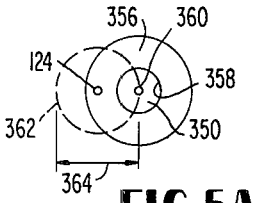
FIG. 5A is a diagrammatic view, slightly enlarged, illustrating the eccentric drive imparting the horizontal movement to the feed carrier of FIG. 5.
Figure 6:
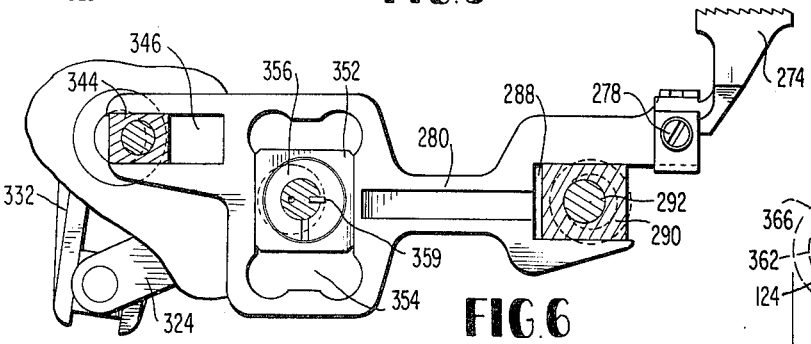
FIG. 6 is an elevation view taken along line 6—6 of FIG. 4 and illustrating the front feed dog carrier drive.

Referring to FIGS. 4 through 6, it is seen that the feed carriers 280, 282 are driven in their horizontal work feeding movement through substantially identical scotch yoke assemblies by an eccentric crank portion 350 on shaft 30 projecting outwardly from the end wall 42. The scotch yokes each consist of a generally rectangular guide block 352 supported for relative vertical sliding movement within a generally rectangular opening 354 in the body of the respective feed carriers, with the guide blocks 352 being restrained against horizontal movement relative to the feed carriers by the vertical walls of the rectangular openings 354. The guide blocks 352 are each provided with a large, concentric circular opening extending therethrough for rotatably receiving a circular bushing 356 having an eccentric axial bore 358 extending therethrough and mounted by key 359 on the eccentric crank portion 350 of shaft 30. In order to facilitate the explanation of the function of eccentric bushing 356, this element is illustrated in FIGS. 5 and 5A as having zero eccentricity and in FIGS. 6 and 6A as having substantial eccentricity. Thus, in the configuration illustrated in FIGS. 5 and 5A, it is seen that upon each rotation of shaft 30 about its longitudinal axis 124, the center of the eccentric crank portion 350 and of the center of the concentric bore 358 will coincide at 360 and will move about the circular path indicated by the broken line 362. This action will impart horizontal movement to the feed carrier 284 indicated by the arrow 364 in FIG. 5A, with the extent of the horizontal movement equal to two times the eccentricity of crank 350.

Figure 6A:
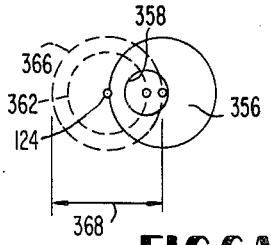
FIG. 6A is a view similar to FIG. 6 and illustrating the eccentric cam drive adjusted for maximum horizontal stroke.
Figure 7:
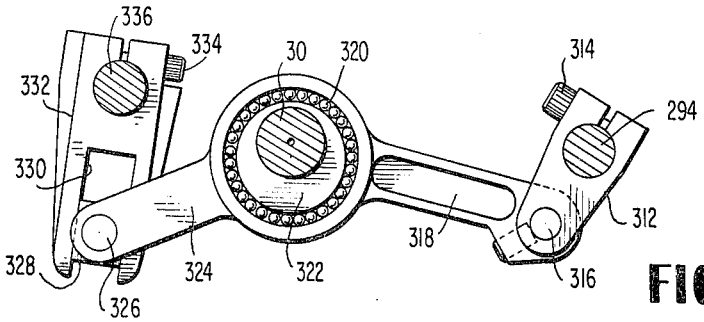
FIG. 7 is a sectional view taken along 7—7 of FIG. 4 and illustrating the feed raising drive mechanism.

When it is desired to impart a greater horizontal stroke to the feed carriers, an eccentric cylinder 356 having a bore 358 formed therein which is offset with regard to the center of the cylindrical bushing is employed. In this configuration, as illustrated in FIG. 6A, the eccentricity of the bore 358 is added algebraically to the eccentricity of the crank portion 350 so that the center of the cylindrical eccentric sleeve 356 follows the circular path indicated by the broken line 366, thereby imparting a greater horizontal stroke as indicated by the arrow 368. Oviously, by rotating the cylinder 356 through 180°, a substantially shorter horizontal stroke is obtained.

It is apparent that, in use of the machine, cylindrical bushings having the same eccentricity and orientation will normally be employed for both of the feed carriers to thereby impart identical horizontal strokes to the feed dogs 274, 276. However, when it is desired to provide differential movement between the two feed dogs, as during a shirring operation, the cylindrical bushings can be employed to impart greater movement to the front feed dog to produce the desired shirring effect in the work material.

Since the feed raising shaft 292 is driven by input shaft 30, the feed dogs 274, 276 are raised and lowered by the feed raising block 290 in timed relation to the horizontal movement imparted thereto by the scotch yoke assembly, it is seen that the feed dogs travel in a substantially elliptical path. Further, since shaft 336 is oscillated about its longitudinal axis by an extension of the connecting arm 318 which drives the feed raising shaft 294, the feed carrier guide block 344 is shifted vertically in timed relation with the feed raising block 290. By providing the desired degree of eccentricity to the crank portion 342 of shaft 336, it is apparent that the feed carriers 280, 284 may be maintained in an essential horizontal attitude so that the longitudinal axis of the elliptical path ascribed by the feed dogs is truly horizontal rather than canted as is the case where the feed carriers are pivoted about a fixed axis at the rear portion thereof. This action enables a more uniform pressure to be applied to the material during feeding thereof beneath the presser foot with the results that more uniform and accurate feeding is possible.

Referring now to FIGS. 9 and 10, a shaft mounted pump assembly 370 is mounted on and supported by shaft 30 to provide lubricating oil to the main shaft bearing 44, the feed raising bearing 125, and the feed carrier crank 350. The pump 370 includes a generally cylindrical body made up of two half-sections 372, 374 held in rigidly assembled relation by a pair of bolts 376 between a pair of radially extending shoulders 378, 380 on the shaft 30. The pump body has a concentric axial bore extending longitudinally therethrough and dimensioned to receive and closely fit onto and be freely rotatable on the shaft 30 between the shoulders 378, 380. An eccentric arcuate groove 382 is formed in the shaft between and equally spaced from shoulders 378, 380 and extends approximately 180° therearound. The width of the groove 382 along the length of shaft 30 is substantially less than the axial length of the pump body, and a radial bore 384 is formed in the shaft near the trailing end of the groove 382 relative to the direction of rotation of the shaft 30. Radial bore 384 communicates with a longitudinally extending axial bore 386 formed in shaft 30 from the end thereof extending through wall 48.

A radially extending threaded bore 388 is formed in pump body portion 372 and a tubular oil supply nipple 390 is threaded into the bore to provide an oil supply passage to the concentric bore 392 of the pump body. A flexible plastic tube sleeve 394 is received in telescoping relation on the oil supply nipple 390 and extends downwardly therefrom terminating within the oil supply sump 20 adjacent the bottom of the machine housing. Preferably the lower end of the plastic sleeve 394 is disposed within an upwardly directed open recess 396 within the bottom cover plate 16 of the housing, with the walls of the recess 396 acting as stops to restrain the pump assembly against free rotation about the axis of the shaft 30.

A second radially extending bore 398 is formed in pump body portion 372, and an elongated cylindrical piston 400 is slidably mounted within this bore. Bore 398 is positioned in closely spaced circumferential relation to and ahead of bore 388 relative to the direction of shaft rotation so that the bore 384 in shaft 30 passes the bore 398 immediately before passing over the bore 388 during normal operation of the pump. The piston 400 has a diameter substantially equal to the width of the eccentric arcuate groove 382 and is positioned in radial alignment therewith so that upon relative rotation of the shaft 30 and the pump body, the radially inward end of piston 400 is pressed into engagement with the surface of the shaft and of the eccentric arcuate groove 382 by the leaf spring 402 resiliently engaging the radially outer end of the piston. As seen in FIG. 9, spring 402 is firmly clamped on the pump body by one of the bolts 376.

As shown in FIG. 9, the pump 370 hangs free on the shaft 30, with any slight tendency for the pump to be rotated with the shaft (due to frictional contact) being resisted by engagement of the tube 394 with the walls of the recess 396 within the oil reservoir. Rotation of the shaft 30 from the position shown in FIG. 9 will cause a progressive shifting of the open space formed between the groove 382 and the cylindrical bore 392 of the pump body past the piston 400 and over the open end or radial bore 388. The springs 402 keep the piston 400 pushed inward into contact with the surface of the groove 382 so that the expanding volume of the space passing over the bore 388 creates a suction drawing a finite volume of oil through the oil inlet nipple 390 to trap the volume of oil between the undercut eccentric portion of the shaft and the concentric bore of the pump. Further rotation of the shaft will move the radial bore 384 past the oil inlet tube 390 and pressure exerted by spring 402 on the piston 400 will tend to force the trapped oil from eccentric arcuate groove radially inward through the bore 384 for delivery into bore 386. The oil then progresses axially along bore 386 and outward through radially extending bore 404 to lubricate bearing 125, bore 406 to lubricate bearing 44, and bore 408 to lubricate the bearing surfaces between the eccentric crank 350 and the eccentric bushings 356. Also, metering screws 410, 412 and bleed opening **410*a*** may be provided to limit the volume of oil pumped by the device or supplied to any point of oil consumption.

Referring to FIG. 11, it is seen that the feed carrier eccentric cylinders 356 are provided with radially extending grooves 414 to provide an escape path for a limited volume of oil to lubricate the interface surfaces of the feed carriers and the adjacent frame surfaces. By providing the metering screw 412 to allow only a minimum amount of oil to enter this area, excessive oil loss is avoided.

Lubrication of the major portion of the moving parts of the machine contained within the housing 10 is supplied by an oil slinger spoon 416 mounted by bolts 150 on the end of the lower looper drive connecting rod 146 in position to dip into the oil reservoir in the bottom of the housing upon each revolution of the auxiliary drive shaft 60. Additional lubrication is provided by the splashing effect of the lower end of the upper looper carrier arm 160 which is driven axially into the oil upon each revolution of the auxiliary shaft. Oil splashed and slung in this manner can readily be directed over the top of the inner walls, 48, 72 to provide lubrication for the miter gears and associated bearings. Alternatively, if positive lubrication is desired for the main shaft bearings, the axial bore 386 in the main shaft 30 can be extended therethrough with suitable radial bores being provided to supply lubricating oil from the pump 370.

In summary, the invention involves the combination of a number of novel features which cooperate in their overall operation to produce an improved, high speed overedge sewing machine. Thus, for example, the novel concept of employing right angle shafts in an overedge machine makes it possible to balance the machine with much greater accuracy, thereby substantially reducing one of the prime causes of vibration, noise, and wear. This shaft arrangement also greatly simplifies the drive mechanism by making it possible to employ simple articulated bar linkage mechanisms, each mounted in its own fixed plane, for driving the individual components of the machine. These planar linkages make possible the greater utilization of anti-friction bearings and generally avoid the known disadvantages of spatial linkages and cams as basic drive components.

The simple drive structure also makes it feasible to drive the feed carriers in a mode to move the four-motion feed dogs in a path more closely approximating a true ellipse rather than the egg-shaped path resulting from restraining one end of the feed carriers against vertical movement as in the conventional machines. Similarly, the novel drive shaft arrangement facilitates the mounting of the upper looper for reciprocation in a path extending upwardly from within the machine housing. This angular arrangement reduces the rotational movement required to carry a loop of thread around the edge of the workpiece in position to be penetrated by the needle. Further, lubrication of the entire mechanism is simplified by use of the inclined upper looper rod as an oil slinger. Thus, while I have disclosed and described a preferred embodiment of my invention, I wish it understood that I do not intend to be restricted solely thereto, but that I do intend to include all embodiments thereof which would be apparent to one skilled in the art which come within the spirit and scope of my invention.

I claim:

1. A trimming mechanism for sewing machines including, in combination, an elongated oscillatory cutter arm supporting a movable cutting blade for movement in a fixed plane, a fixed cutter blade positioned to cooperate with said movable cutter blade to trim a workpiece on the machine, a flat end surface on said cutting arm, a groove formed in the flat end surface dividing the end portion of said cutting arm into a pair of parallel spaced flanges, a cutter mounting bracket for supporting said movable cutter blade mounted on the end portion of said cutter arm, said mounting bracket having a flat reference surface adapted to engage said flat end surface on said cutting arm to position said movable cutter blade, a flange on said mounting bracket extending outwardly from and perpendicular to said reference surface and projecting therefrom a distance slightly less than the depth of said groove, a screw fastener extending through and cooperating with the flanges on said cutter arm and said mounting bracket for rigidly mounting said mounting bracket on said cutter arm, and cooperating cam means on said screw fastener and said flange on said bracket operable to cam said flat end surface and said reference surface into firm surface-to-surface contact to accurately align said bracket on said cutter arm upon tightening said screw.

2. The trimmer as defined in claim 1 further comprising a second flange formed on said mounting bracket and projecting from said reference surface in parallel spaced relation to said first flange, said first and second flanges on said mounting bracket being spaced apart a distance to receive one of said flanges on said cutting arm, a threaded aperture in said second flange adapted to receive said screw fastener to firmly clamp said mounting bracket on said cutting arm.

3. The trimmer as defined in claim 2 further comprising an elongated slot formed in and extending through each of said flanges on said cutter arm for receiving said threaded fastener whereby said mounting bracket can be adjusted on said cutter arm in a direction parallel to said flanges.

4. The trimmer as defined in claim 2 wherein said cooperating cam means comprises a substantially cone-shaped section on said screw fastener adapted to engage a complementary cone-shaped opening in said one flange of said mounting bracket.

* * * * *